United States Patent [19]

Bastian et al.

[11] Patent Number: 4,700,916

[45] Date of Patent: Oct. 20, 1987

[54] CANTILEVER ARM ASSEMBLY FOR MODULAR FURNITURE

[75] Inventors: John M. Bastian; David C. Pflieger, both of Two Rivers; Marshall K. Beck, Manitowoc, all of Wis.

[73] Assignee: Hamilton Industries, Inc., Two Rivers, Wis.

[21] Appl. No.: 870,888

[22] Filed: Jun. 5, 1986

[51] Int. Cl.[4] ..... F16B 2/18

[52] U.S. Cl. ..... 248/225.2; 248/243; 211/192; 211/193

[58] Field of Search ..... 211/192, 193; 248/225.2, 243, 242; 108/108

[56] References Cited

U.S. PATENT DOCUMENTS

| | | | |
|---|---|---|---|
| 1,089,863 | 3/1914 | Owen . | |
| 2,060,760 | 11/1936 | Keil | 248/243 X |
| 2,136,109 | 11/1938 | Kress | 248/243 X |
| 2,741,449 | 4/1956 | Heselov | 248/243 |
| 3,273,847 | 9/1966 | Berman | 248/243 |
| 3,966,158 | 6/1976 | Boundy | 248/224.4 X |
| 4,013,254 | 3/1977 | Boundy | 248/243 |
| 4,133,433 | 1/1979 | Wolf | 211/192 |
| 4,134,564 | 1/1979 | Hanna | 248/243 |
| 4,146,140 | 3/1979 | Suter | 211/190 |
| 4,387,872 | 6/1983 | Hogue | 248/221.3 |
| 4,498,653 | 2/1985 | Quest | 248/243 X |
| 4,531,698 | 7/1985 | Sharber | 248/243 |

FOREIGN PATENT DOCUMENTS

| | | | |
|---|---|---|---|
| 473919 | 3/1951 | Canada | 248/243 |
| 1002002 | 12/1976 | Canada | 248/243 |
| 4196 | 9/1979 | European Pat. Off. | 248/242 |

*Primary Examiner*—Ramon S. Britts
*Assistant Examiner*—Blair M. Johnson
*Attorney, Agent, or Firm*—Tilton, Fallon, Lungmus

[57] ABSTRACT

A cantilever arm assembly and its associated structure for modular furniture systems, such as laboratory and office furniture systems, in which such cantilever support arms may be connected to slotted standards at selected elevations to support worktops, cabinet units, shelving, and the like. Each arm is rigidly joined to a vertically-elongated mounting member equipped at its upper end with a series of hooks receivable in the slots of the standard. At its lower end, the mounting member is equipped with a locking element movable between extended and retracted positions and, when extended, projects into one of the slots of the standard to secure the mounting member against upward movement that might result in unintentional unlatching of the hooks. In addition, the locking element, when extended, causes slight pivotal movement of the mounting member to force hooks of the vertical series into tight wedging engagement with the slotted standard as well as to adjust the support arm into level condition.

13 Claims, 8 Drawing Figures

21
21a
21b
27
12
30
30a
30b
15
15a
15c
16
17
14
24
32
8
8
z
x
45
44
41
43
40
42
46

CANTILEVER ARM ASSEMBLY FOR MODULAR FURNITURE

BACKGROUND AND SUMMARY

U.S. Pat. Nos. 4,013,254 and 4,146,140 disclose support structures including hook-equipped brackets and slotted standards for supporting shelves, cabinets, and other furniture units at any of a variety of selected elevations. U.S. Pat. Nos. 4,133,433 and 3,273,847 disclose means for selectively tightening or loosening the hooks of brackets received by slotted uprights, U.S. Pat. No. 4,387,872 discloses a spring-loaded plunger for preventing unintentional detachment of hooks from a slotted standard, and U.S. Pat. No. 2,741,449 discloses a bracket equipped with means for adjusting the bracket, and a shelf which it supports, into horizontal position. Other patents, such as U.S. Pat. Nos. 4,531,698 and 4,134,564, further illustrate the state of the art.

The present invention is concerned with a cantilever arm assembly which may be easily connected and disconnected from a slotted standard and may be positioned at any of a variety of elevations along that standard. Once such a position has been selected, a user actuates locking means which not only prevents unintentional unhooking of the cantilever arm assembly from the standard but also eliminates play or looseness in the interconnection between the parts and, in addition, may be manipulated to adjust the support arm, and any worktop carried by that arm, into true horizontal position.

An important aspect of the assembly is the provision of a vertically-elongated mounting member that is rigidly connected at its upper end to the horizontal support arm (by a rigid internal casting) and is provided at its upper end with a vertical series of hooks adapted to be received and latched into slots provided by a standard or upright. The mounting member has a major proportion of its vertical length extending downwardly below the series of hooks and terminating in a lower end portion spaced above the bottom of the standard. The locking means for preventing accidental upward displacement of the mounting member is located at the lower end of that member and takes the form of a screw having an enlarged head portion engagable with the standard and a pin extension adapted to be received in one of the slots of the standard. Extension of the screw causes the pin to enter a slot and, since a plurality of hooks are provided at the upper end of the mounting member, all of which are received in slots of the standard, rotation of the screw to force its head into tight engagement with the standard results in slight pivotal movement of the mounting member and causes the hooks to pivot into tight frictional engagement with the standard. Such rotation of the screw also pivots the free end of the cantilever arm upwardly, thus permitting a limited range of adjustment for shifting the arm into precise horizontal position.

The secure interlocking relationship between the mounting member of the cantilever arm assembly and the slotted standard is important not only in preventing unintentional release should lifting forces be exerted upon the free end of the arm, as where a worktop secured to the arm, or a cabinet suspended from it, should be lifted or bumped upwardly, but also because it resists disengagement or loosening in response to vibrations, tremors, even earthquakes. While obviously there can be no guarantees against earthquake damage, the cantilever arm assembly of this invention is highly resistant to disengagement from a slotted standard to which it is locked and must be subjected to considerable distortion and damage before any such release can take place.

Other features, advantages, and objects of the invention will become apparent from the specification and drawings.

DRAWINGS

DETAILED DESCRIPTION OF PREFERRED EMBODIMENT

Figure 7:
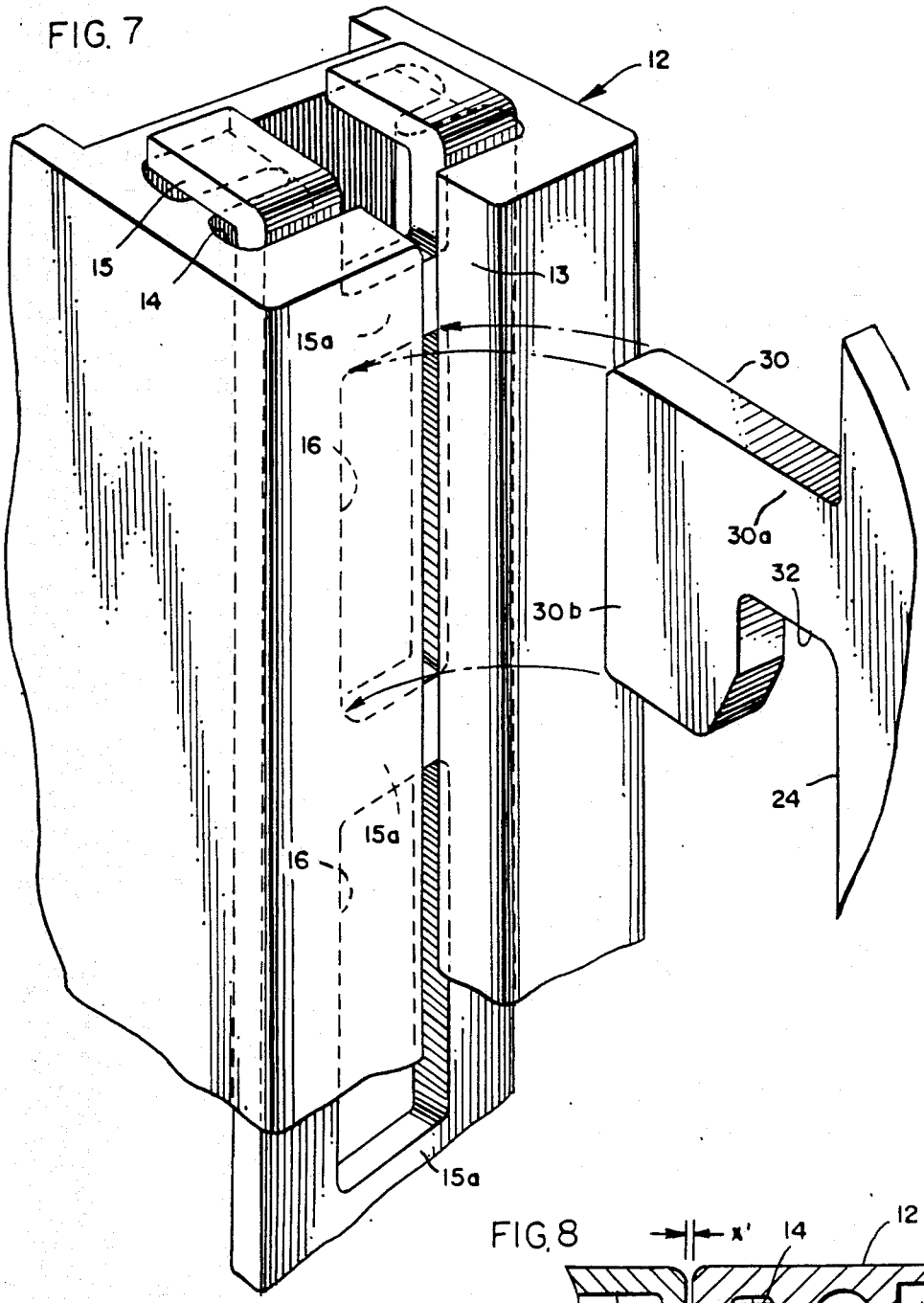
FIG. 7 is a perspective view illustrating details of the standard and its relationship to a hook portion of the mounting member.
Figure 8:
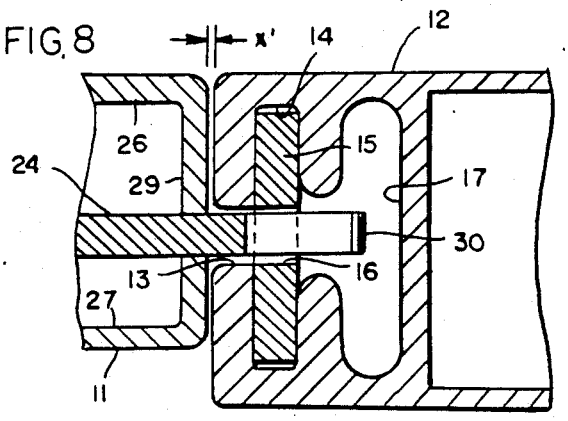
FIG. 8 is a fragmentary sectional view taken along line 8—8 of FIG. 6.

Referring to the drawings, the numeral 10 generally designates the combination of a cantilever support arm assembly 11 and a vertical column or standard 12. The standard may be part of a partition or panel structure or, alternatively, may be wall mounted or supported in some other manner well known in the art. In the form illustrated, it is composed of an aluminum extrusion having a longitudinal opening or channel 13 along at least one side (FIGS. 7 and 8). The opening communicates with a two-chamber cavity, the outer chamber 14 receiving and retaining a slotted bar 15 of steel or similar material. The bar has a multiplicity of uniformly-spaced slots or notches 16 arranged in a vertical series, each slot being aligned with the longitudinal access opening 13. A second chamber 17 is disposed inwardly of chamber 14 and, like the first chamber, extends the full vertical extent of the extruded column. Approximately one-half of the column or standard 12 is shown in section in FIG. 8; the other half may be identical, with a second slotted bar 15 disposed in a duplicate of vertical chamber 14. To immobilize the bar 15 against vertical movement within the compartment in which it is received, the ends of the bar may be turned at right angles over the ends of the column as shown in FIG. 7.

Figures 1, 2, 3, 4, 5:
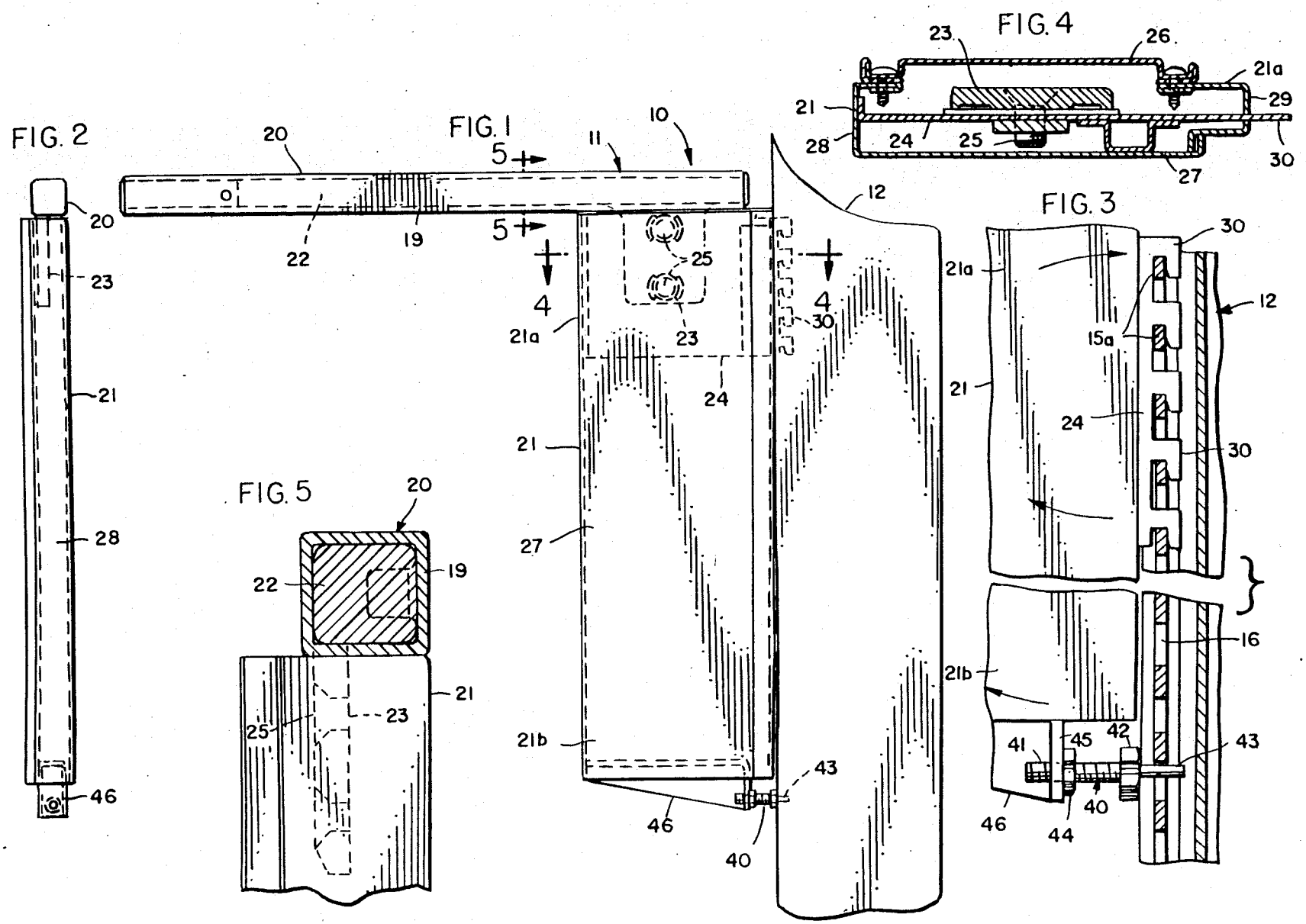
FIG. 1 is a side elevational view of an assembly embodying this invention.
FIG. 2 is a front elevational view of the assembly.
FIG. 3 is an enlarged view showing the relationship between the vertically-elongated mounting member and the slotted standard.
FIG. 4 is an enlarged horizontal sectional view taken along line 4—4 of FIG. 1.
FIG. 5 is a greatly enlarged cross sectional view taken along line 5—5 of FIG. 1.

The cantilever arm assembly 11 includes a generally horizontal support arm 20 rigidly secured to an elongated upstanding mounting member 21 (FIG. 1). Rigidity and strength are important because arm 20 (or a plurality of such arms supported by a plurality of identical standards) may be used to support a counter or worktop, shelving units, cabinetry, and the like (not shown). The modular components that may be mounted upon or suspended from the support arm 20 do not constitute part of this invention and may be any of a variety of typical components well known in the art.

Rigidity is achieved, first, by reinforcing horizontal arm 20 and by providing a non-flexing and non-yielding interconnection between that arm and mounting member 21, and second, by achieving a rigid interlock between the mounting member 21 and column 12. The support arm is in the form of a box beam or casing 19 that may be formed from sheet stock (e.g., steel sheeting) or, alternatively, may be extruded from aluminum or other suitable material It is reinforced by a core 22 that is press-fitted within the casing. The core is cast from iron or other material having high rigidity and strength and, as shown most clearly in FIG. 1, the casting 22 is generally L-shaped with a leg portion 23 that projects downwardly from casing 19 into the upper end of mounting member 21. In addition to its other advantages, such a construction eliminates the need for any supporting gusset or brace beneath arm 20 that might interfere with leg movement of a user.

The depending leg 23 is secured to a generally rectangular vertical plate 24 by screws 25, and the plate is in turn secured within the upper end portion 21*a* of the mounting member as indicated in FIG. 4. The mounting member includes a pair of vertical side walls 26 and 27, a rear wall 28, and a front wall 29. As revealed in FIGS. 3, 4, and 8, plate 24 protrudes through a vertical slit in front wall 29 and is formed to provide a vertical series of hooks 30 extending forwardly from the upper end portion of mounting member 21. A series of five hooks is shown and, although that number is not critical, the series should have substantial vertical extent (i.e., substantial spacing between the uppermost and lowermost hooks, with such hooks received in non-consecutive or non-adjacent slots of the series of slots) to achieve sufficient rigidity and security and to insure the locking action described hereinafter.

Figure 6:
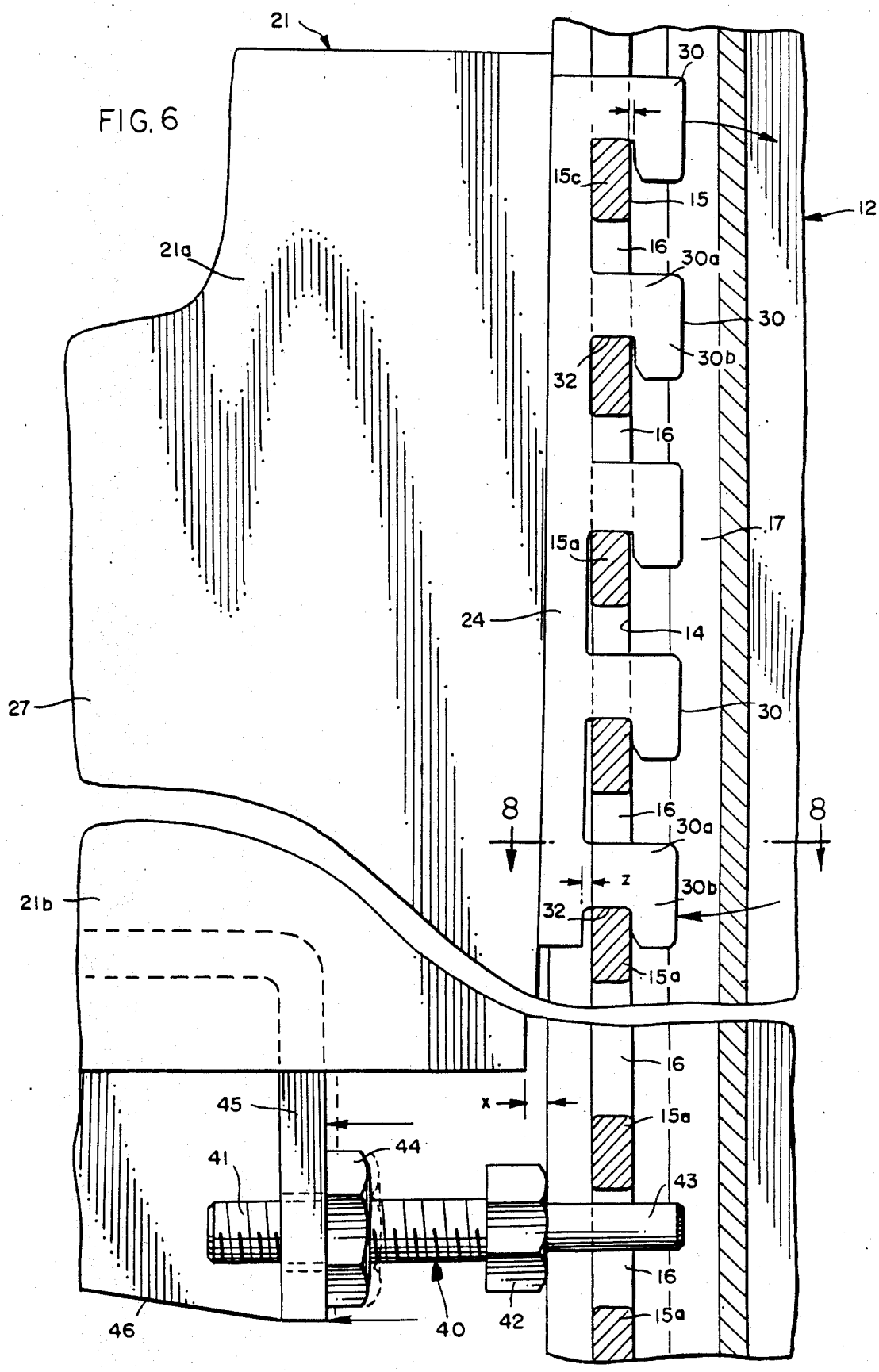
FIG. 6 is a still further enlarged fragmentary vertical sectional view similar to FIG. 3 but showing in somewhat schematic form the structural relationships responsible for the secure interlocking action of the parts.

Each hook 30 is of inverted L-shape, having a horizontal leg 30*a* and a depending leg 30*b*, the latter being spaced from the remainder of plate 24 to define a downwardly-facing recess 32 (FIGS. 6 and 7). The width of that recess, measured along the plane of plate 24, is slightly greater than the thickness of the slotted bar 15 of standard 12 or, more particularly, the thickness of the horizontal web portions 15*a* that define the upper and lower limits of each of the slots or recesses 16 (FIG. 6). Also, the vertical distance between the lower end of one leg portion 30*b* and the top of the next hook directly therebelow slightly exceeds the height of each connecting web portion 15*a*. The result is that the series of hooks 30 may be easily connected to and disconnected from the notched standard at any of a variety of positions along the length (height) thereof.

The relationship described above results in a slightly "loose" interfit between the series of hooks 30 and the standard 12 that facilitates the initial step of mounting the cantilever arm assembly. However, means are provided at the lower end of the vertically-elongated mounting member 21 to pivot the lower end outwardly or rearwardly to a very limited extent, thereby shifting the hooks 30, and especially the upper and lower hooks of the series, into tight frictional engagement with connecting webs 15*a* of standard 12. The canted relationship is depicted in somewhat exaggerated form in FIG. 6 where it will be seen that the depending leg of the uppermost hook 30 is spaced forwardly of web 15*a* at a distance "y" and the opposing surface of plate 24 is in tight engagement with the rearwardly-facing surface of that web, whereas just the opposite relationship exists with respect to the lowermost hook 30 and the connecting web which it engages. The depending leg portion 30*b* of the lowermost hook has its rear surface in tight engagement with web 15*a* and a slight spacing "z" exists between the rear surface of the web and the forwardly-facing surface of the plate within recess 32. Other hooks of the series also contribute, but to a lesser extent, to the frictional interlocking of the parts with the exception of the intermediate hook which rests upon its connecting web 15*a* but may not engage, or at least tightly engage, both the front and rear surfaces of that web.

The means for pivoting the lower end portion 21*b* of the mounting member 21 away from standard 12 to produce a tight interfit of the hook 30 comprises a screw 40 having a threaded shank 41, an enlarged head portion 42 at the forward end of the shank, and a reduced portion or pin extension 43 projecting forwardly from head portion 42 (FIG. 6). The shank 41 is threadedly received by an internally threaded female member 44 which, in the embodiment illustrated, takes the form of a nut welded or otherwise permanently secured to the depending arm 45 of a bracket 46 secured to the lower end portion 21*b* of the mounting member 21.

Prior to installation of the cantilever arm assembly, member 40 is screwed rearwardly so that head 42 is disposed against or in close proximity to element 44 of the bracket. After the hooks at the upper end of the mounting member have been fitted into the slots of the standard and are hooked within those slots, screw 40 is extended so that its reduced pin extension 43 protrudes into one of the slots 16 of the standard (FIGS. 3 and 6). Continued rotation of the screw 40 causes head 42 to bear more forcefully against the rear surface of the standard, with the result that the entire vertically-elongated mounting member 21*a* pivots in a clockwise direction (as viewed in FIG. 6) about its hook-equipped upper end portion. A slight spacing "x" develops between the lower front surface of the mounting member 21 and the rear surface of the standard, the spacing "x" being somewhat exaggerated in FIG. 6 for clarity of illustration. Such pivotal movement results in a tightening of the hooks as already described and, in addition, pivots the entire cantilever arm assembly so that the free end of arm 20 is lifted slightly. The extent of such lifting may be varied by the extent to which screw 40 is tightened, it being understood that limited continued movement is possible even after the hooks 30 tightly engage webs 15*a* because the forces exerted by screw 40 are great enough to cause limited deflection or distortion of the webs and/or hooks. Therefore, leveling of arm 20, and any worktop or modular component carried by it, may be achieved within narrow limits by adjusting screw member 40.

It should be noted that even when the head 42 of adjusting member 40 does not forceably engage standard 12 but is only in close proximity to that standard, the threaded locking member 40 will nevertheless prevent disengagement of the cantilever arm assembly from the standard. To unlatch the hooks from the standard, the mounting member 21 must be lifted a distance sufficient to permit the hooks to be extracted from slots 16. Pin 43 is dimensioned and positioned so that when the hooks 30 engage webs 15*a* as shown in FIG. 6, pin 43 prevents the cantilever arm assembly from being lifted a distance sufficient to allow disengagement of the hooks. Specifically, with the locking member 40 extended as shown, lifting of the arm assembly will cause pin 43 to engage the underside of a web 15*a* and thereby prevent continued lifting movement to the extent needed for hook disengagement. Lifting movement to the extent needed for disengagement is possible only when the locking member 40 has been retracted to withdraw pin 43 from slot 16.

The rigidity of the interconnection between the cantilever arm assembly 11 and the standard 12 also arises in part because of the vertical length of the elongated connecting member 21 and because the connecting hooks 30 are located at the upper end of that member while the locking/pivoting means 40 is located at the member's extreme lower end. As shown in FIG. 1, a major proportion of the length or height of connecting member 21 is disposed below the series of connecting hooks. The connecting member 21 therefore functions as an extended lever arm with the pivoting action occurring about a pivot zone at the member's upper end and with the locking forces being exerted by adjustment of locking means 40 at the member's extreme lower end.

While in the foregoing we have disclosed an embodiment of the invention in considerable detail for purposes of illustration, it will be understood by those skilled in the art that many of these details may be varied without departing from the spirit and scope of the invention.

We claim:

1. In combination with a standard having a multiplicity of uniformly-spaced slots arranged in a vertical series along at least one side thereof, a cantilever arm assembly comprising a generally horizontal support arm and a vertically-elongated mounting member secured to said support arm and having an upper end portion provided with a vertical series of outwardly and downwardly projecting hooks, said hooks being received in slots of said standard for latching engagement therewith and being disengagable from said standard by first lifting said mounting member and then moving said hooks outwardly from said slots, said vertically-elongated mounting member having a major proportion of its vertical length disposed below said series of hooks anad terminating in a lower end portion spaced above the bottom of said standard, and positive locking means provided at said lower end portion of said mounting member, said locking means being shiftable between a locking position, in which said means enters one of said slots for blocking upward movement of said mounting member and thereby preventing unlatching of said hooks, and a releasing position wherein said means is retracted from said slot and permits upward unlatching movement of said hooks, means whereby said hooks being are slightly loosely received in said slots when said locking means is in its releasing position, said locking means being forceably engagable with said standard to urge the lower end portion of said mounting member in a direction away from said standard and thereby force the uppermost and lower-most hooks of said series into tighter frictional engagement with said standard.

2. The combination of claim 1 in which said locking means comprises a screw member threadedly mounted at the lower end of said mounting member and projecting towards said standard, said screw member including an enlarged head portion engagable with the outer surface of said standard facing towards said mounting member and a reduced extension projecting from said head portion and received in a slot of said standard.

3. The combination of claim 1 in which each of said hooks projects from the edge of a vertical plate and includes a horizontal leg portion and an integral depending leg portion, said standard having horizontal web portions interposed between the slots of said series, the distance between said depending leg portion of said hook and the edge of said plate being greater than the width of said web portion received therein when said cantilever arm assembly is hooked upon said standard.

4. The combination of claim 1 in which the upper and lower hook of said series are spaced a substantial distance apart with the slots receiving said upper and lower hooks being non-consecutive slots of said series.

5. The combination of claim 1 in which said standard is extruded and includes a cavity having inner and outer chambers extending the length thereof, said standard also having a longitudinal opening extending along one wall thereof and communicating directly with said outer chamber, and an elongated rigid metal bar received in said outer chamber, said multiplicity of uniformly-spaced slots being formed in said bar and being accessible through said longitudinal opening of said standard.

6. The combination of claim 1 in which said support arm comprises a hollow casing and a reinforcing casting extending longitudinally therein, said casting having a depending portion received and securely anchored within the upper end portion of said mounting member.

7. The combination of claim 6 in which said depending portion of said casting is connected directly to a rigid vertical plate disposed within the upper end portion of said support member, said rigid vertical plate being fixed within said mounting member.

8. The combination of claim 7 in which said hooks of said series constitute integral portions of said plate protruding through one wall of said mounting member.

9. A cantilever arm assembly for connection to a standard having a multiplicity of uniformly-spaced slots arranged in a vertical series along at least one side thereof, said cantilever arm assembly comprising a generally horizontally support arm and a vertically-elongated mounting member secured to said support arm and having an upper end portion and a lower end portion, said upper end portion being provided with a vertical series of outwardly and downwardly projecting hooks, said vertically-elongated mounting member having a major proportion of its vertical length disposed below said series of hooks, and positive locking means provided at the lower end portion of said mounting member at a point spaced substantially below the lowermost hook of said series, said locking means being shiftable between an extended locking position, in which said means projects from said mounting member for insertion into one of the slots of a standard for blocking upward movement of the mounting member and thereby preventing unlatching of said hooks from the standard, and a releasing position wherein said means is retracted for permitting upward unlatching movement of said hooks, means whereby said hooks are slightly loosely received in said slots when said locking means is in its releasing position.

10. The cantilever arm assembly of claim 9 in which said locking means comprises a screw member threadedly mounted at the lower end of said mounting member and projecting outwardly in the same direction as said hooks, said screw member including an enlarged head portion adapted to engage the outer surface of a standard and a reduced extension projecting from said head portion for insertion into a slot of such standard.

11. The cantilever arm assembly of claim 9 in which each of said hooks projects from the edge of a vertical plate secured within said mounting member.

12. The cantilever arm assembly of claim 11 in which said support arm comprises a hollow casing and a reinforcing casting extending longitudinally therein, said casting having a depending portion received and securely anchored within the upper end portion of said mounting member.

13. The cantilever arm assembly of claim 12 in which said depending portion of said casting is connected directly to said vertical plate.

* * * * *